United States Patent [19]

Koizumi

[11] Patent Number: 4,605,095

[45] Date of Patent: Aug. 12, 1986

[54] VERTICAL ELONGATED CHUTE

[75] Inventor: Kenichi Koizumi, Omiya, Japan

[73] Assignee: Fujikura Rubber Ltd., Tokyo, Japan

[21] Appl. No.: 792,819

[22] Filed: Oct. 30, 1985

[30] Foreign Application Priority Data

Oct. 31, 1984 [JP] Japan ..... 59-229689
Oct. 31, 1984 [JP] Japan ..... 59-229690

[51] Int. Cl.[4] ..... A62B 1/20
[52] U.S. Cl. ..... 182/48; 193/25 R
[58] Field of Search ..... 182/48, 49; 193/25 R

[56] References Cited

U.S. PATENT DOCUMENTS 3,348,630 10/1967 Yamamoto ..... 182/48
3,433,323 3/1969 Ukawa ..... 182/48
3,994,366 11/1976 Okuma et al. ..... 182/48
4,099,595 7/1978 Tracy ..... 182/48
4,099,596 7/1978 Tracy ..... 182/48

*Primary Examiner*—Reinaldo P. Machado
*Attorney, Agent, or Firm*—Koda and Androlia

[57] ABSTRACT

An improved vertical elongated chute usable for allowing a person who has to leave a ship to descend on the sea surface in the event of an occurrence of an emergency. The vertically extending main body is made of a base cloth of which both longitudinally extending side edges are jointed to one another to build a tubular zigzag slip down passage. A zigzag slip down passage cloth having a plurality of bent parts in fixedly secured to the base cloth. An inclined slip way is jointed to the lower end of the main body so that the person who has descended through the zigzag slip down passage lands on the platform by way of the inclined slip away. An expansible cloth of which expansibility is determined in the range of 200 to 250% as seen in the longitudinal direction as well as in the peripheral direction of the main body is fixedly secured to each of the bent parts on the zigzag slip down passage cloth. When dead weight of the descending person is exerted on the expansible cloth, the zigzag slip down passage is caused to expand whereby he descends through the zigzag slip down passage smoothly without any occurrence of stoppage at the bent parts on the zigzag slip down passage cloth. Thus, he can land on the platform serving as a liftboat quickly and safely.

16 Claims, 37 Drawing Figures

VERTICAL ELONGATED CHUTE

BACKGROUND OF THE INVENTION

1. Field of the Invention

The present invention relates to a vertical elongated chute and more particularly to improvement of or relating to a vertical elongated chute mounted on a ship to serve as safe means for allowing persons on the ship to escape therefrom by sliding down from the deck or the like of the ship to a platform floating on the surface of sea in the event of occurrence of such an emergency that they should leave the ship.

2. Prior Art

To facilitate understanding of the present invention it will be helpful that a typical conventional vertical elongated chute of the above-mentioned type will be described below with reference to FIGS. 1 to 4.

As shown in FIG. 1 which schematically illustrates the conventional vertical elongated chute as disclosd in U.S. Pat. No. 3,994,366, it essentially comprises a main body 1 adapted to vertically expand to any required configuration and a platform 2 disposed at the lower end of the main body 1 to float on the sea surface W. An inclined slip way 3 is extended in the area as defined between the main body 1 and the platform 2 whereby a person who slips down through the main body 1 safely stands on the platform 2 with the aid of the inclined slip way 3.

A case for accomodating the whole chute therein is provided at the top end of the main body 1. In the event of an occurrence of emergency an operator opens the case 4 and throw down the folded chute from the deck or the like of the ship S where the case 4 is positioned. As the operator throws down the chute, the main body 1 is expanded along the side wall of the ship S and an air chamber 5 of the platform 2 is then automatically filled with compressed air so that the platform 2 assumes the boat-shaped configuration as shown in FIG. 1. As is apparent for the drawing, the platform 2 is covered with a protective curtain 6 which extends between the lower end of the main body 1 and the periphery of the platform 2 in order to give safe feeling to the person who has reached the platform 2.

The main body 1 having the vertical sleeve-shaped configuration essentially comprises a protective layer 7 constituting the outer wall of the main body 1 and a column-shaped slip down passage body 8 coaxially accomodated in the protective layer 7.

As shown in FIG. 2 which illustrates the slip down passage 8 in the expanded state, it comprises a long base cloth 80 having a high intensity of strength and a zigzag passage cloth 81 placed on the base cloth 80. As is readily apparent from FIG. 3, the zigzag passage cloth 81 is fastened to the base cloth 80 by sewing or the like operation so as to constitute a slip down passage 83. Thus, the column-shaped slip down passage 8 is constituted by joining both the longitudinally extending side ends 82 to one another (see FIG. 4).

While a person slips down by way of the zigzag slip down passage 83 which is constituted by the combination of base cloth 80 and zigzag passage cloth 81, descending speed of the person is substantially reduced during zigzag movement through the zigzag slip down passage 83 whereby he is introduced into the inclined slip way 3 to safely reach the platform 2.

During descending movement of the person through the zigzag slip down passage 83 reduction of the descending speed is achieved by abutment of foot portion of the person 9 against the intermediate portion 830 of the zigzag slip down passage 83. At this moment the trunk portion of the person 9 is located at the bent part 831 of the zigzag slip down passage 831. This means that descending movement of the person 9 is carried out while he bends or twists his body in conformance to the geometrical configuration of the zigzag slip down passage 83.

However, due to the fact that the base cloth has less expansibility it is often found that exposed parts on the person are injured and glass or the like accessories carried by him are disengaged from him because of locally increased friction existent on the zigzag slip down passage 83. Further, since there is a fear of causing stoppage of descending movement of the person 9 at the bent part 831, it is necessary that persons 9 who leave the ship enter the chute one after another at a certain interval, resulting in quick reaching of persons to the platform 2 being achieved only with much difficulties.

Generally, a person 9 who leaves the ship puts on his life vest or jacket prior to descending by way of the zigzag slip down passage 83 but the life vest or jacket is usually made of electric insulative cloth. Further, both the base cloth 80 and the zigzag slip down passage cloth 81 are made of electric insulative material to constitute the zigzag slip down passage 83. For the reason static electricity is increasingly accumulated on the body of the person 9 during descending movement via the zigzag slip down passage 83. As is well known, electric discharging is effected radically when the person having thus accumulated static electricity comes in contact with some electric conductor, causing him to be subject to so-called electric shock. In some cases fine sparks are generated at that time. This leads to dangerous explosion when the ship carries inflammable liquid such as gasoline or the like.

SUMMARY OF THE INVENTION

Hence, the present invention has been made with the foregoing background in mind and its object resides in providing a vertical elongated chute of the early-mentioned type which assures that any person slidably descends toward a platform floating on the water surace without any occurrence of stoppage during descending movement of the person through the zigzag slip down passage formed in the vertically extending main body of the chute.

Other object of the present invention is to provide a vertical elongated chute of the early-mentioned type which assures that smooth descending movement of the person is achieved without any necessity for special preliminary training.

Another object of the present invention is to provide a vertical elongated chute of the early-mentioned type which assures that descending movement of the person through the zigzag slip down passage is achieved without any generation of static electricity.

To accomplish the above objects there is proposed according to the invention a vertical elongated chute including a vertically extending long tubular main body having high strength in which a zigzag slip down passage having a plurality of bent parts in the spaced relation as seen in the vertical direction is formed, the tubular main body being constituted by long base cloth of which both vertically extending ends are jointed at one another to build a tubular structure and the zigzag slip down passage being constituted by a zigzag slip down cloth which is fixedly secured to the base cloth, wherein the improvement consists in that expandable cloths adapted to expand under the effect of weight of the descending person are attached to at least the bent parts including the area located in the vicinity of the same on the zigzag slip down cloth.

Since the chute of the invention is so constructed that at least the bent parts including the area located in the vicinity of the same on the zigzag slip down passage expand under the effect of weight of the descending person, the width of the zigzag slip down passage as seen in the cross-sectional plane is caused to increase when a foot portion of the person abuts against the middle part of the tubular passage or a trunk portion of the person turns about the bent parts. Thus, descending movement of the person can be smoothly achieved without any occurrence of bending or twisting the body of the person when moving past the bent parts.

Other objects, features and advantages of the present invention will become readily apparent from reading of the following description which has been prepared in conjunction with the accompanying drawings.

BRIEF DESCRIPTION OF THE DRAWINGS

The accompanying drawings will be briefly described below.

FIG. 28(*b*) is a cross-sectional view of the stabilizing water bag in FIG. 28(*a*);

DETAILED DESCRIPTION OF THE INVENTION

Now, the present invention will be described in greater detail hereunder with reference to the accompanying drawings which illustrate several preferred embodiments thereof.

Figure 2:
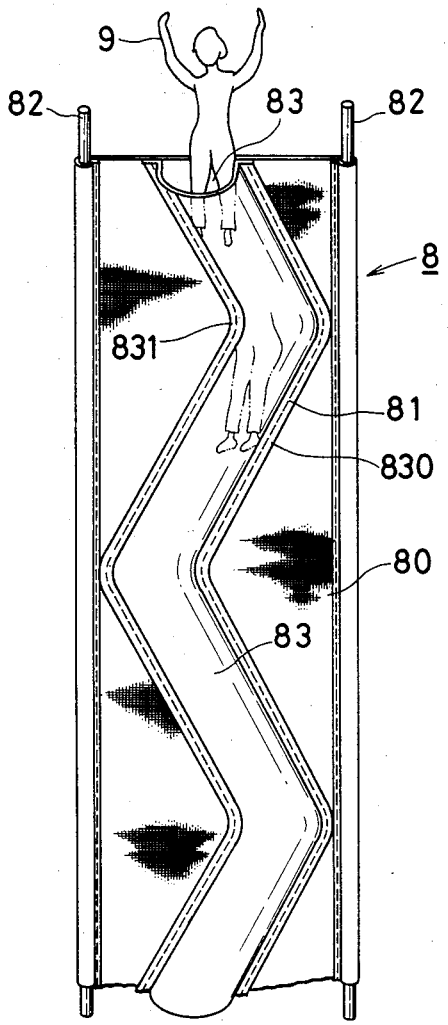
FIG. 2 is a front view of the zigzag slip down passage cloth, shown in the expanded state.
Figure 3:
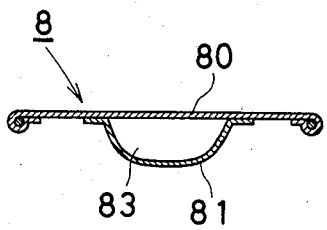
FIG. 3 is a cross-sectional view of the zigzag slip down passage in FIG. 2.
Figure 4:
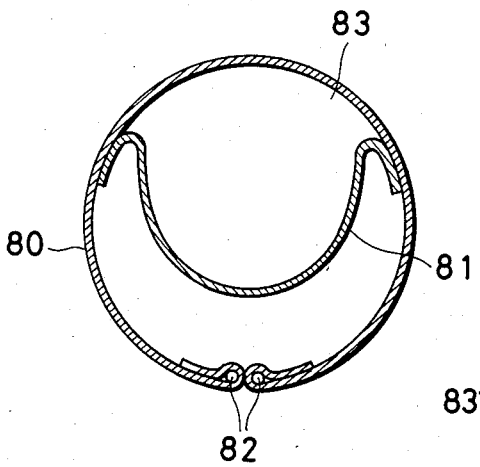
FIG. 4 is a cross-sectional view of the tubular zigzag slip down passage body.

The vertical elongated chute main body 1 of the invention is basically so constructed that a zigzag slip down passage cloth 81 is secured to the base cloth 80 having a high intensity of strength (see FIG. 3) and both the vertically extending ends 82 of the base cloth 80 are jointed to one another (see FIG. 4) to build a tubular structure in the colunn-shaped configuration, as shown in FIGS. 2 to 4.

Figure 5:
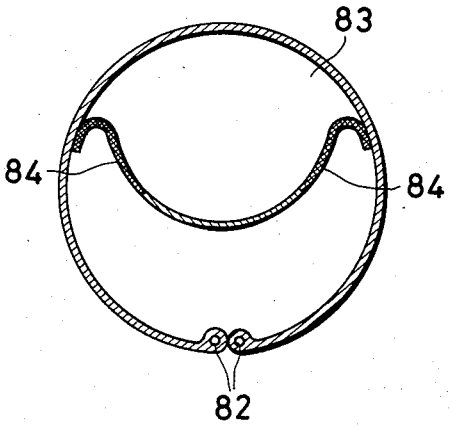
FIG. 5 is a cross-sectional view of the tubular zigzag slip down passage body constituting a vertical elongated chute in accordance with an embodiment of the invention.

The conventional zigzag slip down passage cloth 81 is usually made of cloth having less expansibility. However, according to an embodiment of the invention the zigzag slip down passage cloth 81 is constituted by the combination of central cloth having less expansibility and side cloths 84 having excellently high expansibility located by both the sides of the center cloth, as shown in FIG. 5.

As will be readily apparent, the side cloths 84 having high expansibility are caused to expand under the effect of dead weight of a descending person while he descends along the zigzag slip down passage 83. Thus, smooth descending movement of the person is achieved along the zigzag slip down passage 83 until he reaches the platform 2.

After completion of descending movement of a person the expansible side cloths 84 resume the initial position and thereby the zigzag slip down passage 83 is ready to receive the next person.

Figure 6:
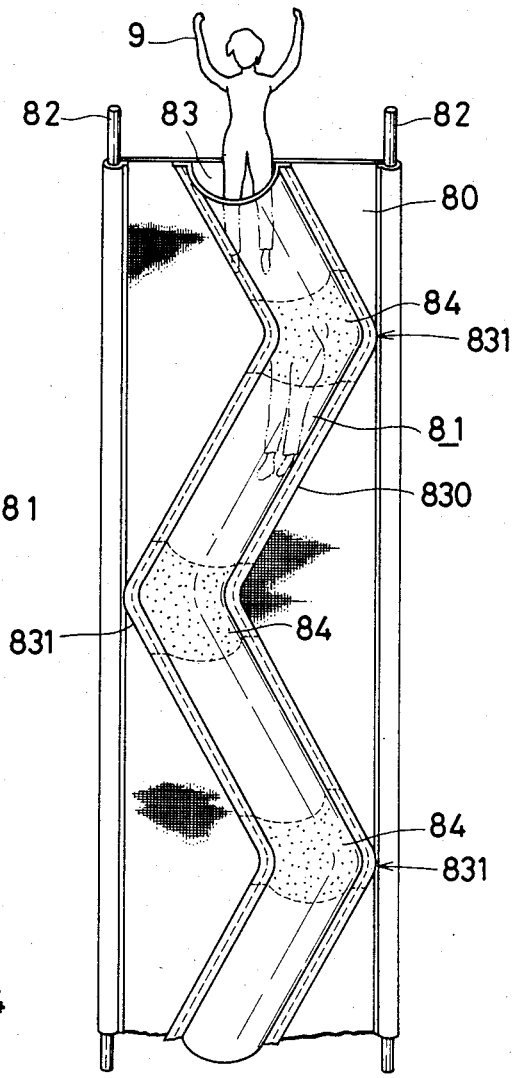
FIG. 6 is a front view of the zigzag slip down passage cloth constituting a vertical elongated chute in accordance with other object of the invention, shown in the expanded state.

FIG. 6 is a plan view of a zigzag slip down passage body 8 constituting the vertical elongated chute in accordance with the second embodiment of the invention. As is apparent from the drawing, the slip down passage 83 of the slip down passage body 8 includes a zigzag slip down passage cloth 81 which is provided with a plurality of bent parts 831 located in the equally spaced relation along the slip down passage 83 and the embodiment of the invention consists in that each of the bent parts 831 including the area located in the proximity of the same is made of expansible cloth 84.

In the case of the conventional vertical elongated chute it is required that a descending person bends or twists his body when his foot portion abuts against the bent part 831 during descending movement of the person, because the material constituting each of the bent parts 831 has less expansibility. On the contrary, since the chute of the invention is so constructed that the expansible cloth 84 expands under the effect of dead weight of the descending person when his trunk portion is inhibitively engaged to the bent part 831. Thus, he can easily move over all the expanded bent parts 84 until he reaches the platform 2 safely.

As mentioned above, it is essential for the invention that each of the expansible cloths 84 has a properly determined expansibility. It is preferable that the slip down passage cloth 81 has expansibility in the range of 30 to 60% as seen in the longitudinal direction and in the range of 15 to 30% as seen in the peripheral direction and breaking strength in excess of 140%, whereas it is preferable that all the expansible cloths 84 have expansibility in the range of 200 to 250% as seen in the longitudinal direction as well as in the peripheral direction and breaking strength in excess of 260%. It should be noted that when expansibility is in excess of 250%, the slip down passage 83 expands excessively and thereby a person 9 is caused to descend at an excessively high speed, resulting in a fear of causing him to be injured, whereas when expansibility is lower than 200%, all the expansible cloth 84 fail to function correctly which means that securing of them to the zigzag slip down passage 83 becomes meaningless.

Further, it is preferable that restorability of the expansible cloths 84 is less than 3%. This is because when it is in excess of 3%, they tend to be kept in the expanded state after a person 9 descends past them and this leads to enlargement of the zigzag slip down passage 83, resulting in descending speed of the person 9 becoming excessively high.

Figure 7:
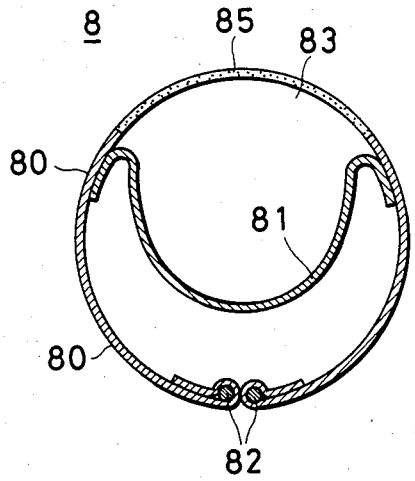
FIG. 7 is a cross-sectional view of the tubular zigzag slip down passage body constituted by electric conductive cloth.

Further, according to the invention at least a part of the zigzag slip down passage 83 is constituted by a cloth 85 having electric conductivity, as shown in FIG. 7.

In order to assure that static electricity is inhibited from an occurrence of accumulation on the body of a descending person 9 it is necessary that the electric conductive cloth 85 has a proper value of resistance suitable for colona discharging. In view of the necessity as mentioned above an electric conductive cloth 85 having resistance value in the range of $10^2$ to $10^5$ ohms should be used. Static electricity accumulated on the body of a descending person 9 is discharged from the electric conductive cloth 85 by way of colona discharge without any possibility of further accumulation of static electricity.

It should be of course understood that the present invention should not be limited only to the electric conductive cloth 85 as shown in the drawing. Electric conductive cloth with electric conductive fiber such as metallic fiber, carbon fiber or the like woven thereinto or electric conductive cloth with a layer of electric conductive cloth 85 paint coated thereon is preferably used as electric conductive cloth 85.

Since the zigzag slip down passage 83 is constituted by the combination of the slip down passage cloth 81, expansible cloth 84 and electric conductive cloth 85, they are required to have a certain intensity of strenght. Further, it is necessary that strength is so determined that they are not broken or injured by a descending person 9 having a heavy weight. This means that they are required to have sufficient strength higher than a practical level of strength. For the reason it is preferable that strength of the slip down passage cloth 81, the expansible cloth 84 and the electric conductive cloth 85 is determined equal to 400 g/m$^2$ (in the case where No. 22 thread is used) or higher than 400 g/m$^2$. Further, it is preferable that the above-mentioned cloths have a tensile strength of 50 Kg/cm or higher than 50 Kg/cm as well as a tearing strength of 17 Kg/cm or higher than 17 Kg/cm.

Moreover, the slip down passage cloth 81 and the electric conductive cloth 85 are required to have a properly determined expansibility. Specifically, it is preferable that they have expansibility in the range of 30 to 60 as seen in the longitudinal direction as well as in the range of 15 to 30% as seen in the peripheral direction, whereas they have breaking strength more than 140%.

Since the vertical elongated chute of the invention is used only in the event of an occurrence of emergency, unexpected trouble or the like relative to a ship, it is normally held in a suitable case or the like means. Accordingly, the expansible cloth 84, the electric conductive cloth 85 and the zigzag slip down passage cloth 81 are required to have proper weather proofness and moreover it is preferable that they have excellent wearing resistance in order to assure that many persons are lead to the platform 2 safely.

With respect to wearing resistance of the zigzag slip down passage cloth 81 and the electric conductive cloth 85 they should be still usable after wearing resistance tests are repeatedly carried out by more than 1000 times. If it is found that the zigzag slip down passage cloth 81, the expansible cloth 84 and the electric conductive cloth 85 fail to exhibit usability after wearing resistance tests are repeatedly carried out by less than 1000 times, there is a fear of causing their breakage during descending movement of many persons. Especially, with respect to the electric conductive cloth 85 it is found that it fails to exhibit electric conductivity as it wears increasingly and this leads to reduced effective function of preventing an occurrence of accumulation of static electricity.

Due to the fact that the zigzag slip down passage 83 is constituted by the combination of expansible cloth 84 and electric conductive cloth 85 it is necessary that they are fastened to the zigzag slip down passage cloth 81 and the slip down passage body 80. To assure proper peeling strength in view of reliable fastening it is preferable that they are made of cloth material which can be fastened together by sewing operation. This is because that adhesive applied to the area of cloth fastened to other one tends to become deteriorated while it is used for a long period of time, when fastening is achieved with use of adhesive.

Further, it is preferable that cloth material used for the vertical elongated chute of the invention is difficult to be burnt, because consideration should be taken on the case where unexpected firing takes place in the ship.

An inclined slip way 3 is jointed to the lower end of the main body 1 of the vertical elongated chute of the invention.

As is well known, a distance as measured between the plane of a deck and the sea surface varies in dependence on a volume of cargo carried in the ship or under the influence of waves rushed on the side wall of the ship. When a distance between the deck and the sea surface W is sufficiently long, the inclined slip way 3 is caused to fully expand to a given dimension whereby an ideal inclination is obtainable. However, in the case where a distance between the case 4 for accomodating the vertical extended chute therein and the sea surface W′ is short, the inclined slip way 3 becomes loosened and thereby it fails to function properly. As a result, a person 9 who enters the inclined slip way 3 after completion of descending through the main body 1 of the vertical elongated chute is caused to reach the platform 2 as if he falls down thereon.

The conventional vertical elongated platform is constructed such that the first person 9 who has stood on the platform 2 carries out adjustment of the effective length of the inclined slip way 3 (see U.S. Pat. No. 3,994,366).

Figure 1:
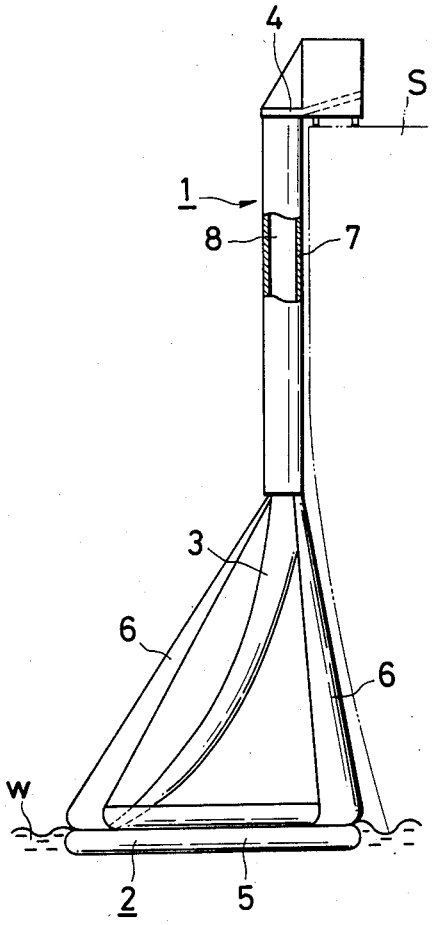
FIG. 1 is a side view of the conventional vertical elongated chute.
Figure 8:
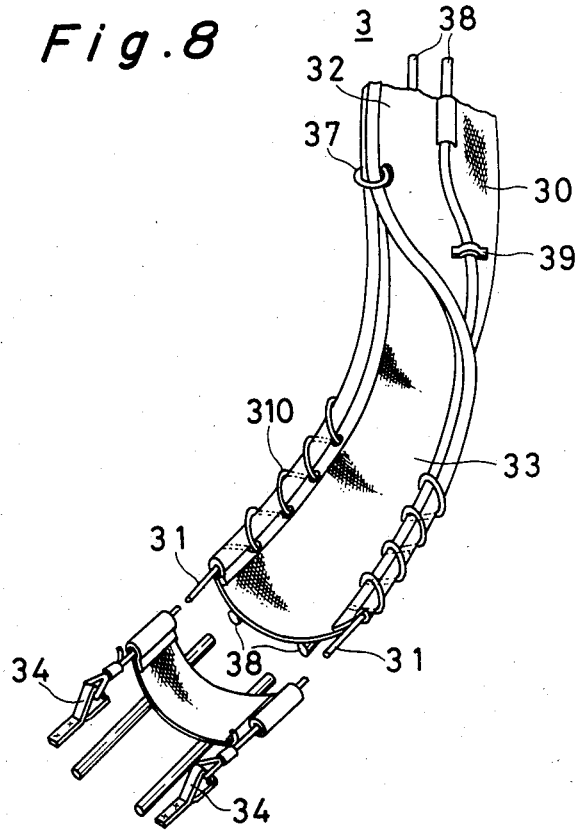
FIG. 8 is a fragmental perspective view of an inclined slip way in accordance with another embodiment of the invention.
Figure 9:
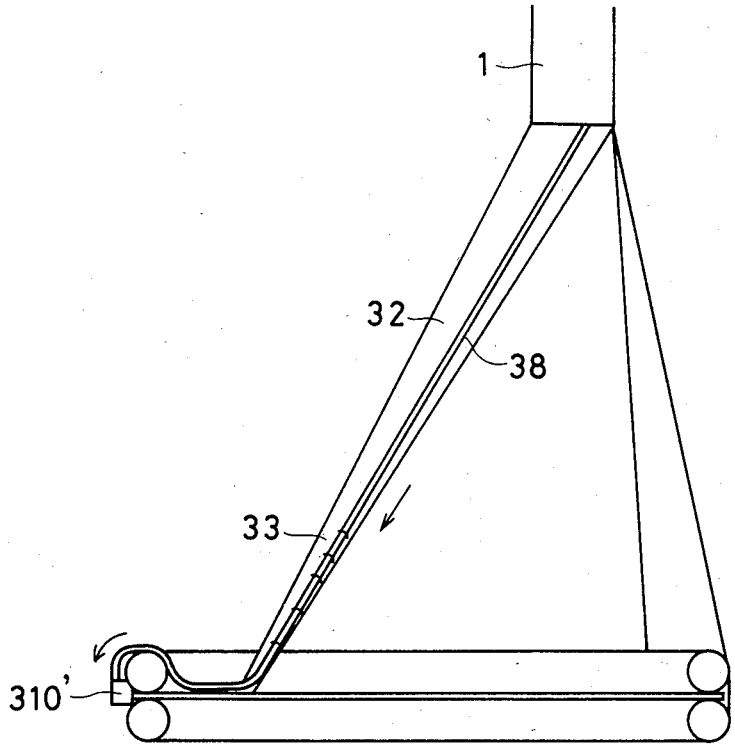
FIG. 9 is a fragmental side view of a vertical elongated chute with braking means attached to thereto in accordance with further another embodiment of the invention.

On the other hand, as shown in FIGS. 1 and 9, the inclined slip way 3 jointed to the lower end of the main body 1 of the vertical elongated chute of the invention comprises a long inclined slip body 30 with ropes 31 involved in both the longitudinally extending ends thereof of which one part is constructed in the tubular structure 32 by allowing both the ends of the body 30 to be jointed to one another by means of rope 3 and of which large part assumes the U-shaped cross-sectional configuration to build a landing section 33 of which upper side is opened to the outside. As is best seen from FIG. 8, the foremost ends of the ropes 31 at the landing section 33 are firmly connected to the fixing accessories 34 on the platform 2. On the other hand, the uppermost end of the tubular section 32 is jointed to the lower end of the main body 1 of the vertical elongated chute (see FIGS. 1 and 9).

Figure 10:
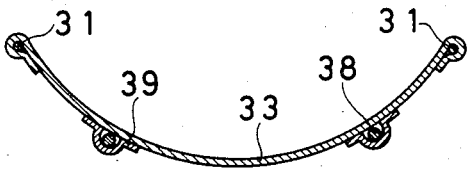
FIG. 10 is a cross-sectional view of the inclined slip way, particularly illustrating the lower end part thereof where a person who has completed descending movement stands upright.
Figure 11:
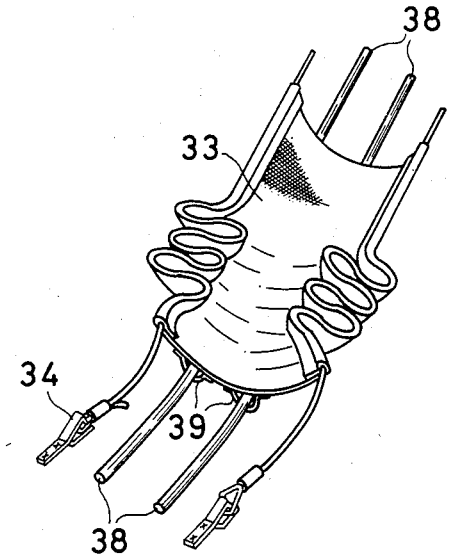
FIG. 11 is a fragmental perspective view of the lower end part of the inclined slip way where a person stands who has completed descending movement stands upright, shown in the contracted state.

As shown in FIGS. 8 to 10, adjustment ropes 38 are attached to both the side walls of the inclined slip way 3. The upper ends of the adjustment ropes 38 are fixedly secured to the lower end of the main body 1 of the vertical elongated chute as well as to both the side walls of the tubular section 32 of the inclined slip way 3 in order to inhibit the latter from moving relative to the main body 1 of the chute. The adjustment ropes 38 extend further to the landing section 33 but they are not fixedly secured thereto. They are inserted through ring-shaped members 39 so that they are movable relative to the inclined slip way body 30 (see FIG. 10). A rubber rope 310 is spirally wound about each of the longitudinally extending ends of the landing section 33 whereby the fore end of the landing section 33 located adjacent to the platform 2 is forcibly pulled toward the tubular section 32. Thus, the inclined slip way body 30 is movable along the two adjustment ropes 38. Since the fore end of the inclined slip way body 30 is fixedly jointed to the platform 2 by means of the fixing accessories 34 and moreover it is pulled toward the tubular section 32 under the effect of elastic force of the rubber ropes 310, the landing section 33 is deformed to the bellows-shaped configuration as the adjustment ropes 38 are caused to contract with the aid of the winding means 310′.

As mentioned above, the foremost end of each of the adjustment ropes 38 is connected to the winding means 310′ which is adapted to normally pull the adjustment ropes 38 toward the platform whereby the adjustment ropes 38 are normally tensioned in the direction identified by an arrow mark in FIG. 9. It should be noted that an excessive length of the adjustment ropes 38 is wound by means of the winding means 310′. Owing to the arrangement made in that way the inclined slip way 3 is held in the stressed state without any loosening recognized.

Since the inclined slip way 3 is constructed in the above described manner, the adjustment ropes 38 are elongated against tensile force of the winding means 310′ due to the fact that the platform 2 has a weight sufficiently larger than the working force of the winding means 310′, when a height as measured from the position where the vertical elongated chute is accomodated on a ship down to the sea surface varies, for instance, when it increases. Thus, the landing section 33 which has been deformed in the bellows-shaped configuration is caused to move along the adjustment ropes 38 in such a direction that the latter expand.

On other hand, when the aforesaid height decreases, the winding means 310′ is operated so as to wind the adjustment ropes 38 whereby the working length of the winding means 310′ is shortened. This causes the expanded landing section 33 to move along the adjustment ropes 38 in such a direction that the latter contract. Thus, they are deformed in the bellows-shaped configuration without any occurrence of loosening of the inclined slip way 3.

The winding means 310′ are so constructed such that elongation of the ropes 38 are prevented when the ropes 38 are suddenly tensioned. When the person 9 slips down the slip way 3, the ropes 38 are suddenly tensioned and the elongation thereof is prevented by the winding means 310′. Accordingly, he is able to smoothly slip down.

Figure 12:
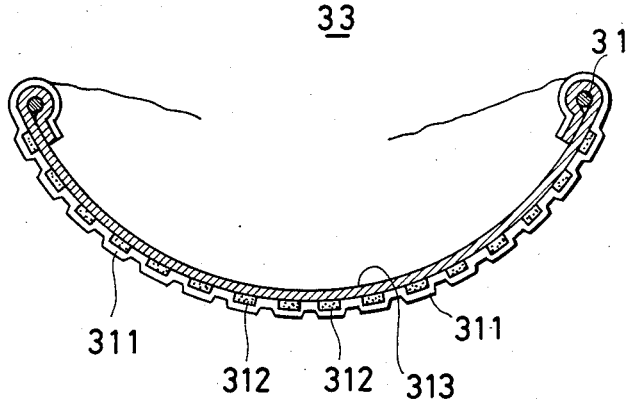
FIG. 12 is a cross-sectional view of the lower end part of the inclined slip way where a person who has completed descending movement stands upright, wherein a layer of shock absorbing material is attached to the bottom of the part.

According to other embodiment of the invention no winding means is used for the inclined slip way 3. As shown in FIG. 12 which is a cross-sectional view of the landing section 33 of the inclined slip way 3, a layer of long protective cloth 311 is placed over the inclined slip way body 30 which is constituted by long cloth material and a plurality of shock absorbing members 312 are interposed therebetween in the equally spaced relation.

Figure 13:
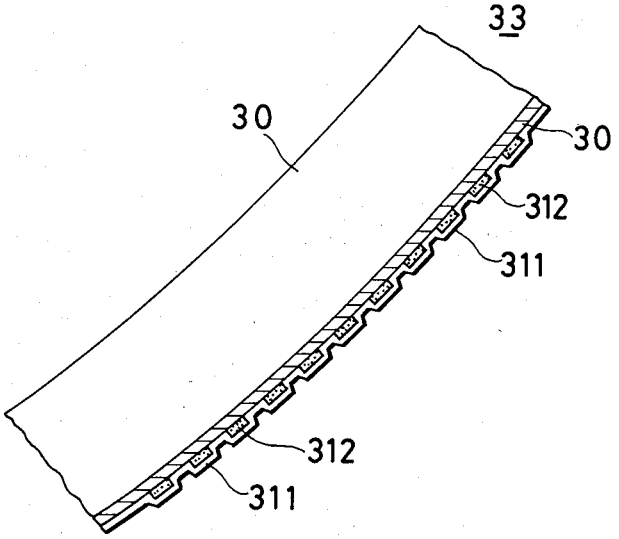
FIG. 13 is a fragmental vertical sectional view of the lower end part of the inclined slip way in FIG. 12.

Further, as is apparent from FIG. 13 which is an enlarged sectional side view of the landing section 33, the shock absorbing members 312 are embedded not only in the longitudinal direction but also in the transverse direction in the equally spaced relation. In this embodiment it is necessary that the inclined slip way 3 is foldable. For the reason the shock absorbing members 312 are embedded in that way in order that folding is effected in both the longitudinal and transverse directions.

Since the shock absorbing members 312 employed for the embodiment are intended to damp shock caused by descending movement of a person 9, they are preferably distributed in the area over the bottom 313 of the landing section 33 having the U-shaped cross-sectional configuration. However, in view of the fact that a person 9 does not always reach the area located in the vicinity of the bottom 313 of the landing section 33 it is preferable that the shock absorbing members 312 are distributed over the area extending from the bottom 313 to both the side parts.

It is preferable that each of the shock absorbing members 312 has excellently high elasticity and moreover in view of the fact that the vertical elongated chute is accomodated in the case 4 for a long period of time it is preferrable that they are made of material having excellent weather proofness. For instance, foamed polyurethane, foamed polyvinylchloride or the like foamed material are typically employed as material for the shock absorbing members 313.

When no winding means 310′ is used, the first person 9 should undertake adjustment of the length of the inclined slip way 3 in the above-mentioned manner immediately after he stands on the platform 2.

Obviously, it is possible to use the shock absorbing members 312 in combination with the winding means 310′. In this case, the shock absorbing members 312 function effectively even when the winding means 310′ fails to operate properly.

A person 9 who has descended through the inclined slip way 3 reaches the platform 2 safely and stands thereon.

Figure 14:
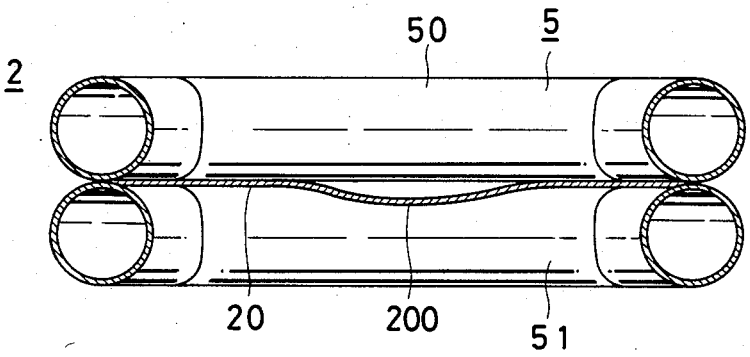
FIG. 14 is a vertical sectional view of the platform constituting a vertical elongated chute in accordance with a modified embodiment of the invention.
Figure 15:
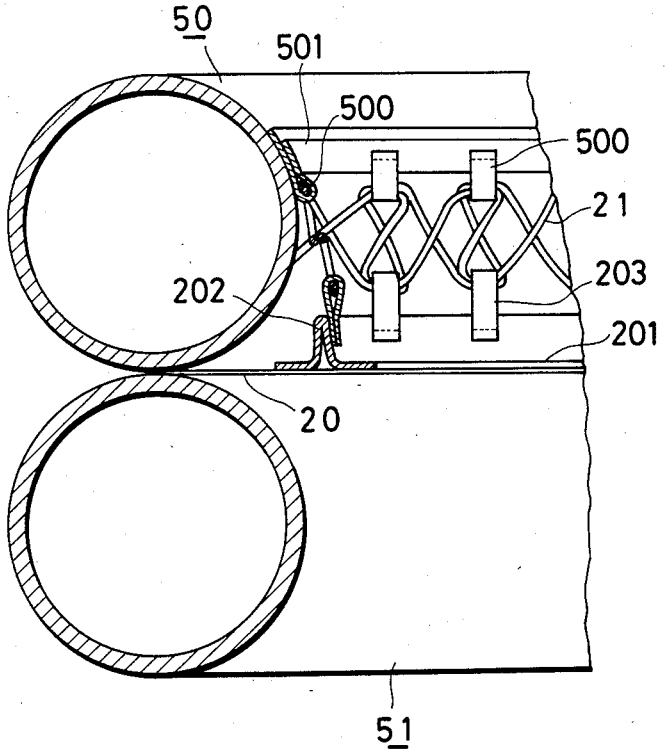
FIG. 15 is a fragmental vertical sectional view of the platform in FIG. 14, wherein tightening means in the form of rope is employed therefor.

As will be readily apparent from FIGS. 1, 14 and 15 the platform 2 includes an air bag 5 adapted to generate buoyancy of the platform 2. The air bag 5 as shown in FIGS. 1 to 12 comprises an upper air bag 50 and a lower air bag 51 and a floor cloth 20 is positioned between both the upper and lower air bags 50 and 51 as if it is clamped therebetween. Thus, a person 9 stands on the floor cloth 20 of the platform 2 after he completes descending movement through the main body 1 and the inclined slip way 3.

The platform 2 serves not only as place where a person 9 who leaves the ship stands on safely but also as base from which he removes onto a lifeboat (not shown) floating on the sea at the position adjacent to the platform 2. Accordingly, it is necessary that the platform 2 is so designed that any person 9 stands on there safely after completion of descending movement through the main body 1 and the inclined slip way 3 and then he remove the lifeboat without any particular difficulty.

When the platform 2 having the basic structure with the floor cloth 20 held between both the upper and the lower bags 50 and 51 is loaded with the dead weight of a person who reaches the platform 2, a loosened part 200 is formed in the area on the floor cloth 20 where the dead weight of the person 9 is loaded. This tendency is remarkably recognizable when load is exerted on the central part of the floor cloth 20.

Once the loosened part 200 is formed in the above-mentioned manner, it becomes difficult that the person 9 stands and walks on the platform 2 to remove onto the lifeboat or the like means quickly and safely.

According to another embodiment as illustrated in FIG. 15 the upper air bag 50 is provided with a plurality of rope engagement loops 500 which are distributed over the whole inner periphery thereof in the equally spaced relation so that ropes are extended through the loops 500. The latter are attached to a band-shaped base cloth 501 by sewing operation or the like, wherein the band-shaped base cloth 501 is adhesively secured to the whole inner periphery of the upper air bag 500.

On the other hand, the floor cloth 20 is provided with a supporting cloth 201 around the peripheral part thereof which includes a projection 202 having an inverted V-shaped cross-sectional configuration and a plurality of floor cloth 20 tightening loops 203 are attached to the projection 202 in the equally spaced relation by sewing operation or the like. In the illustrated embodiment the rope engagement loops 500 and the floor cloth 20 tightening loops 203 are located opposite to one another but the present invention should not be basically limited only to the position where they are disposed in the above-described manner.

When ropes 21 are extended through the rope engagement loops 500 and the floor cloth 20 tightening loops 203 and they are then tightened by force, the floor cloth 20 is pulled upwardly toward the upper air bag 50 whereby it is stretched in the area as defined by the lower side of the upper air under the effect of a proper intensity of tightening force.

Figure 16:
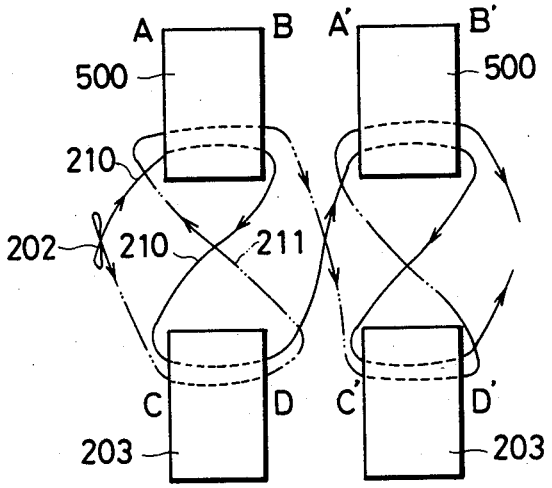
FIG. 16 is a schematic front view particularly illustrating how the tightening ropes are used.

The present invention should not be basically limited only to the method of tightening the ropes 21 in the above-mentioned manner. For instance, tightening may be effected as schematically illustrated in FIG. 16. Specifically, the extreme ends of two ropes 210 and 211 are bound to one another at the position as identified by reference numeral 202. First, the one rope 210 is inserted through the rope engagement loop 500 from the left side A to the right side B and it is then inserted through the floor cloth tightening loop 203 from the left side C to the right side D as seen in the drawing. Further, it is inserted through the rope engagement loop 500 spaced away from the first-mentioned one from the left side A′ to the right side B′ and it is then inserted through the floor cloth tightening loop 203 from the left side C′ to the right side D′ as seen in the drawing. It is successively inserted through the rope engagement loops 500 as well as the floor cloth tightening loops 203 located opposite to the former in the vertically aligned relation in the above-described manner (as shown by a real line in FIG. 16).

On the other hand, the other rope 211 is first inserted through the floor cloth tightening loop 203 from the left side C to the right side D and it is then inserted through the rope engagement loop 500 from the left side A to the right side B. Further, it is inserted through the floor tightening loop 203 spaced away from the first-mentioned one from the left side C' to the right side D' and it is then inserted through the rope engagement loop 500 located opposite to the formed in the vertically aligned relation from the left side A' to the right side B' as seen in the drawing. It is successively inserted through both the loops 203 and 500 in the above-described manner (as shown by a two-dot chain line in FIG. 16). As a result, the required tightening can be achieved.

As is apparent from FIGS. 15 and 16, the ropes 210 and 211 are extended in the 8-shaped pattern while they are successively inserted through the loops 500 and 203. Finally, the other extreme ends of the ropes 210 and 211 are bound to one another by force whereby the floor cloth 20 is pulled toward the upper aid bag 50 until the firmly tightened state is obtained.

Since the tightened state is assured for the floor cloth 20 in that way, there is no fear of causing undesirable loosening of the floor cloth 20 and thereby a person 9 can removed from the platform 2 onto a life boat or the like means quickly and safely.

Figure 17:
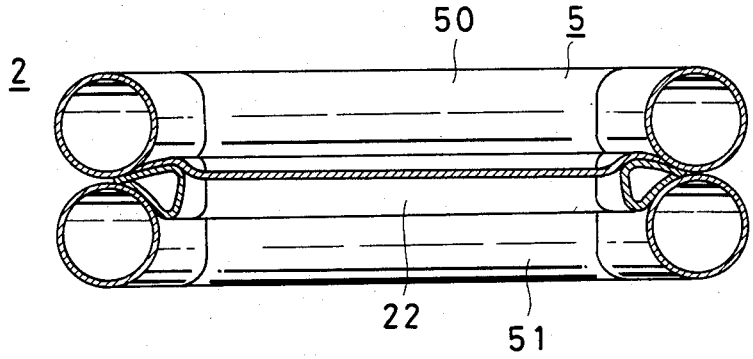
FIG. 17 is a vertical sectional view of the platform constituting a vertical elongated chute in accordance with other modified embodiment of the invention, wherein an additional annular air bag is employed for the purpose of reinforcement of the platform.

According to a modified embodiment as illustrated in FIG. 17 a tightening air bag 22 is provided around the whole lower periphery of the floor cloth 20. Namely, the tightening air bag 22 is firmly held together with the floor cloth between the upper air bag 50 and the lower air bag 51 in such a manner that it is pneumatically communicated with the upper air bag 50 and/or the lower air bag 51. Therefore, it starts its expansion when the upper air bag 50 and/or the lower air bag 51 start their expansion. As the tightening air bag 22 expands increasingly, interference takes place between it and the upper part of the lower air bag 51 whereby the floor cloth 20 is raised up around the whole periphery thereof.

In the above-described embodiment arrangement is made such that the tightening air bag 22 is pneumatically communicated with the upper air bag 50 and/or the lower air bag 51. However, the present invention should not be limited only to this. Alternatively, the tightening air bag 22 may be provided with a specific bomb (not shown) which is manually opened to expand the tightening air bag 22 for the purpose of stretching the floor cloth 20, as required.

As described above, the foregoing embodiment consists in that a tightening air bag 22 is firmly held together with the floor cloth 20 between both the upper and lower air bags 50 and 51 in order to raise up the floor cloth 20 around the whole periphery thereof under the effect of expansion of the tightening air bag 22 while the latter interferes with the upper part of the lower air bag 51. However, the present invention should not be limited only to the arrangement made in that way. Any arrangement may be employed for the platform 2, provided that it is so made that the floor cloth 20 is raised up from the bottom side thereof with the aid of a tightening air bag 22.

Figure 18:
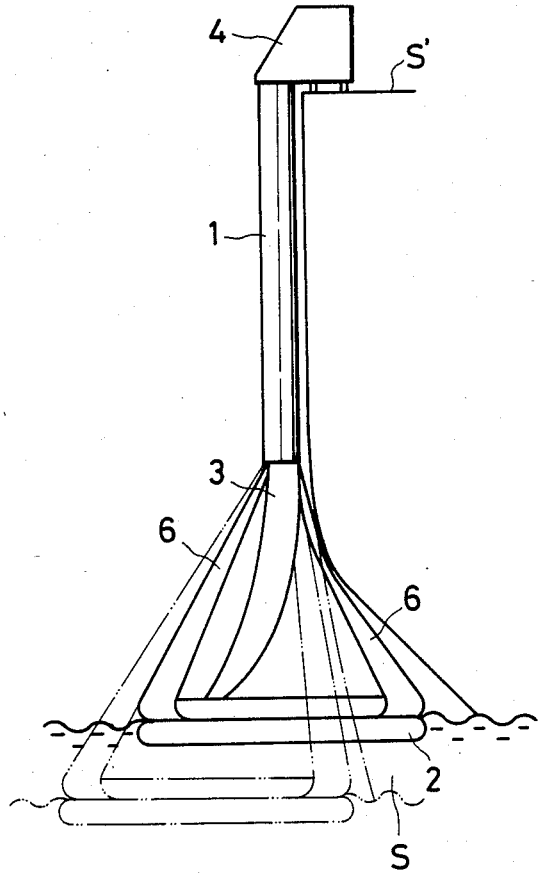
FIG. 18 is a schematic side view of the vertical elongated chute of the invention, particularly illustrating how its position relative to the side wall of a ship varies.

As shown by real lines in FIG. 18, the platform 2 tends to move toward the side wall of a ship S' until it enters into the space as defined by the bottom of the ship S' or into the space located below the projected part of a wavy extinguishing device, when the side wall of the ship S' is inclined at a steep inclination angle in the area extending from the side to the bottom of the ship or the ship S' is equipped with the wave extinguishing device on the side wall thereof. In the above-mentioned case it becomes impossible that the inclined slip way 3 has a gentle slope, resulting in it failing to function properly.

In view of the foregoing problem there is proposed according to an embodiment of the invention an arrangement of an air bag column on the platform of the vertical elongated chute.

Figure 19:
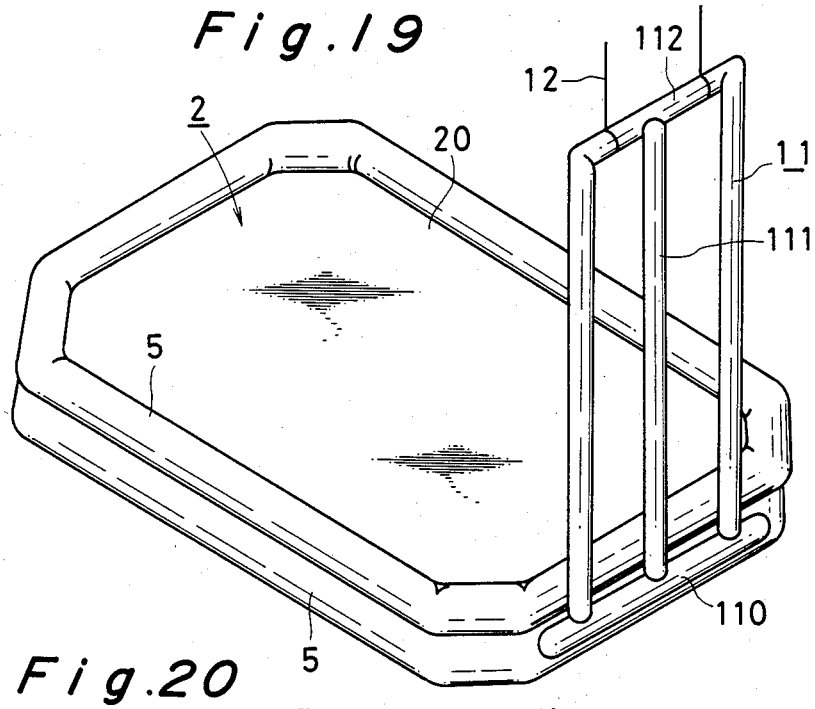
FIG. 19 is a perspective view of the platform with three air bag columns standing upright therefrom.
Figure 20:
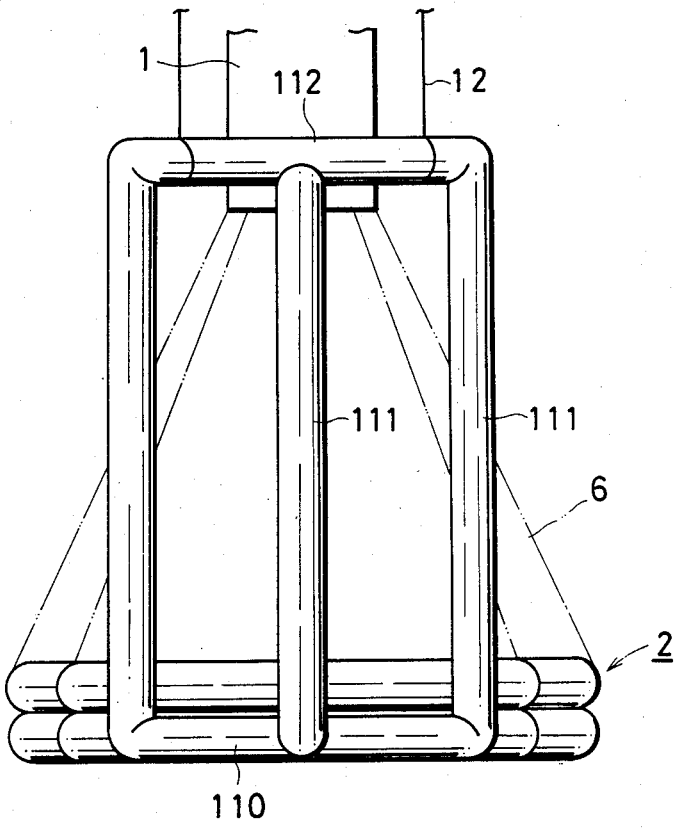
FIG. 20 is a rear view of the platform in FIG. 19.

Specifically, as shown in FIGS. 19 and 20, a column-shaped air bag is generally represented by reference numeral 11 stands upright on the air bag 5 of the vertical elongated chute. The air bag column 11 includes a lower transversely extending air bag 110 which is pneumatically communicated with the air bag 5 of the platform 2 and moreover it includes a plurality of vertically extending air bags 111 which stand upright from the transverse air bag 110. The vertical air bags 111 are pneumatically communicated with an upper transversely extending air bag 112 at the uppermost end thereof. Both the upper and lower transverse air bags 112 and 110 are intended to inhibit transverse movement of the vertical air bags 111 and exhibit a high intensity of resistance against force which is active for inclining the vertical air bags 111 in the direction oriented away from the same while they are connected to one another by way of both the upper and lower transverse air bags 112 and 110.

The upper transverse air bag 112 has rope 12 bound thereabout and the other ends of the ropes 12 are jointed to, for instance, the case 4 for accomodating the vertical elongated chute or the main body 1 in FIG. 1. Obviously, the ropes 12 assist in allowing the air bag column 11 to normally stand upright.

Figure 21:
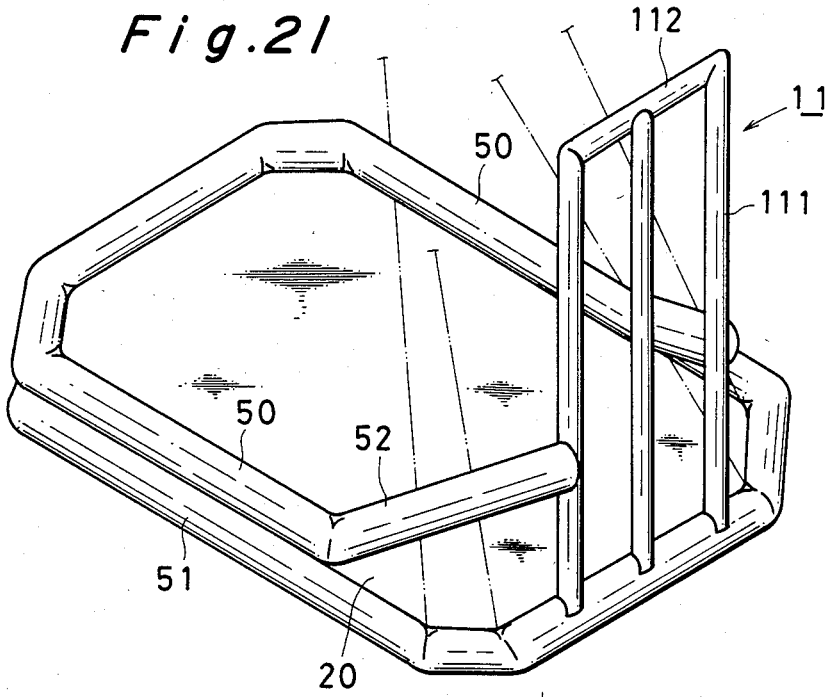
FIG. 21 is a perspective view of the platform similar to FIG. 19, wherein another additional air bag column is attached to the platform.
Figure 22:
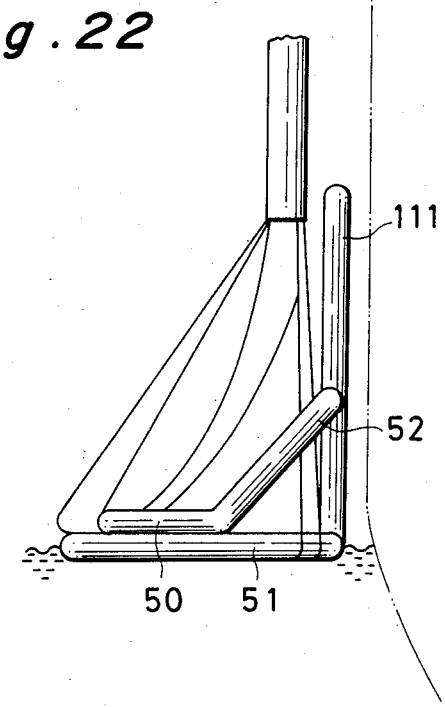
FIG. 22 is a side view of the platform in FIG. 21.

FIG. 21 is a perspective view of a vertical elongated chute in accordance with a modified embodiment of the invention and FIG. 22 is a side view of the vertical elongated chute in FIG. 21. As is apparent from the drawings, the air bag column 11 stands upright directly from the air bag 5 on the side located opposite to the side wall of a ship. As shown in FIG. 21, the air bag column 11 includes three vertical air bags 111 and an upper transverse air bag 112 which is pneumatically communicated with the vertical air columns 111 at the uppermost end thereof.

In this embodiment a part of the upper air bag 50 is inclined upwardly to build an inclined portion 52 on both the sides of the platform 2. Each of the inclined portion 52 is pneumatically communicated directly with one of the vertical air bags 111 located on the outer side (see FIG. 22).

When the vertical elongated chute of the invention is taken out of the case 4 on the deck of a ship S and it is then thrown down on the surface of the sea, the main body 1 is caused to extend vertically along the side wall of the ship S and the air bag 5 of the platform 2 is automatically filled with pressurized gas so that it expands to assume the boat-shaped configuration. In the case of the platform 2 as illustrated in FIGS. 19 and 20 the air bags 110, 111 and 112 are filled with pressurized gas, because the air bag 5 is pneumatically communicated with the vertical air bags 111 and the upper transverse air bag 110. Owing to the arrangement made in that way the air bag column 11 is allowed to stand upright at the position located in the proximity of the side wall of the ship as the air bag 5 expands (see FIG. 23).

In the case of the platform 2 as illustrated in FIGS. 21 and 22 the vertical air bags 111 are pneumatically communicated with the lower air bag 51 and moreover the upper air bag 50 including the inclined portions 52 is pneumatically communicated directly with the vertical air bags 111. Thus, the vertical air bag column 11 is allowed to stand upright as the air bag 5 expands.

Figure 24:
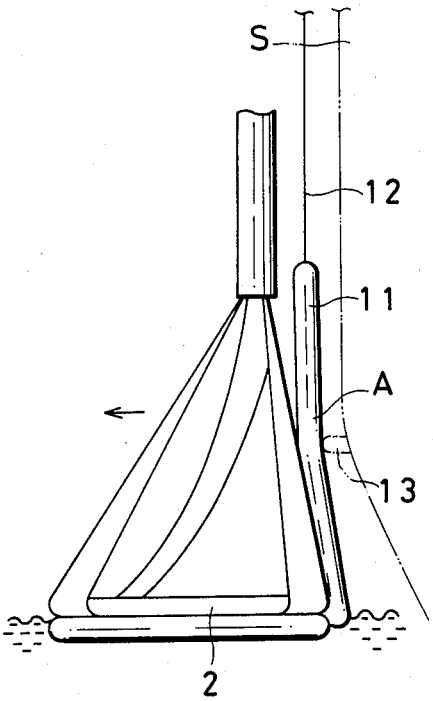
FIG. 24 is a side view of the platform in FIG. 19, particularly illustrating how the air bag columns function.
Figure 23:
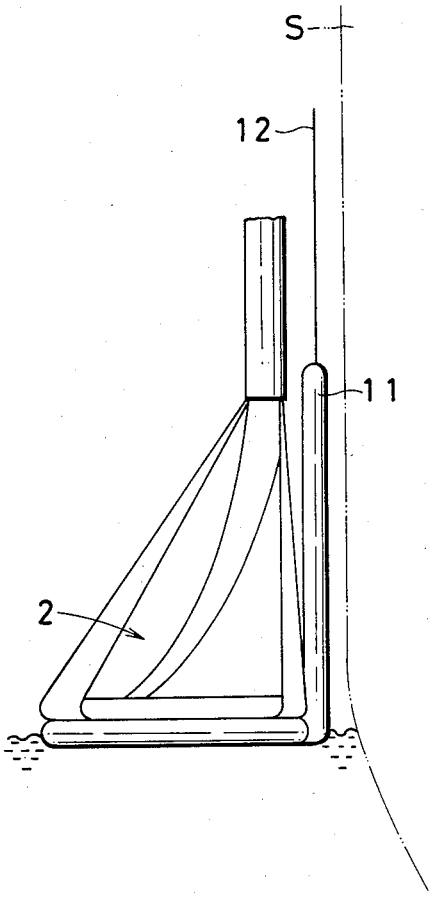
FIG. 23 is a side view of the platform in FIG. 19.

The vertical elongated chute of the invention with the platform 2 attached thereto functions properly without any trouble accompanied as along as the platform 2 assumes the predetermined position relative to the main body 1 as shown in FIGS. 1, 22 and 23. However, in the case where the ship is provided with a wave extinguishing projection 13 at the bottom area thereof as shown in FIG. 24 or in the case where the bottom part of the ship S is inclined inwardly at a steep inclination angle as shown in FIG. 18 there is a tendency that the platform 2 moves toward the side wall of the ship S. Then, the platform 2 enters into the area located below the wave extinguishing projection 13 or the bottom part of the ship S. Once the undesirable situation has been reached, the air bag column 11 on the platform 2 is caused to bend at the position A where it abuts against the wave extinguishing projection 13 or the side wall of the ship whereby reactive force as identified by an arrow mark in FIG. 24 is generated by the air bag column 11, because the latter stands upright on the air bag 5 of the platform 2 which is connected to the case 4 by way of the ropes 12. The platform 2 is then displaced in the direction away from the side wall of the ship S under the effect of thus generated reactive force. As a result, the platform 2 is taken out of the area located below the bottom part of the ship S or the wave extinguishing projection 13 and thereby it assumes the predetermined position located below the main body 1 of the chute. Thus, any person 9 can remove from the inclined ship way 3 onto the platform 2 safely at all time, because the inclined slip way 3 by way of which the main body 1 of the chute is connected to the platform has reached such a state that it has a gentle inclination angle.

In the case of the platform as shown in FIGS. 19 and 20 two ropes 12 are engaged to the air bag column 11 in order to assure that the latter is difficult to be bent in the direction away from the side wall of the ship S when it abuts against the latter, whereas in the case of the platform 2 as shown in FIGS. 21 and 22 there is no necessity for the ropes 12 in the foregoing embodiment because the upper air bag 50 includes inclined portions 52 so as to inhibit the air bag column 11 from being bent while they are pneumatically communicated with the air bag column 11.

Since the air bag column 11 is adapted to function in such a manner as to displace the platform 2 in the direction away from the side wall of the ship when it abuts against the latter described above, it is obvious that what is required with respect to the air bag column 11 is merely that it stands upright above the air bag 5 of the platform 2 at the position located opposite to the side wall of the ship S.

In the foregoing embodiment the air bag column 11 on the platform 2 is constituted by the combination of three vertical air bags 111 and upper transverse air bag 112 by way of which the vertical air bags 111 are pneumatically communicated with one another, whereas in the previously described embodiment it is constituted by the combination of three vertical air bags 111, upper transverse air bag 112 and lower transverse air bag 110 by way of which the vertical air bags 111 are pneumatically communicated with one another. However, it should of course be understood that the present invention should not be limited only to these embodiments. As mentioned above, the air bag column 11 is intended to displace the platform 2 in the direction away from the side wall of the ship S when it abuts against the latter and therefore all that is required with respect to the air bag column 11 is merely that it stands upright above the air bag 5 at the position located opposite to the side wall of the ship S. For the reason the air bag column 11 may be constituted by a single vertical air bag 111 in an extreme case. Alternatively, it may be constituted by more than 3 vertical air bags 111.

Further, in order to prevent the platform 2 from moving toward the side wall of the ship S it is possible that it is provided with an additional air bag 14 on the air bag 5 in place of the air bag column 11 or together with the same.

Figure 25:
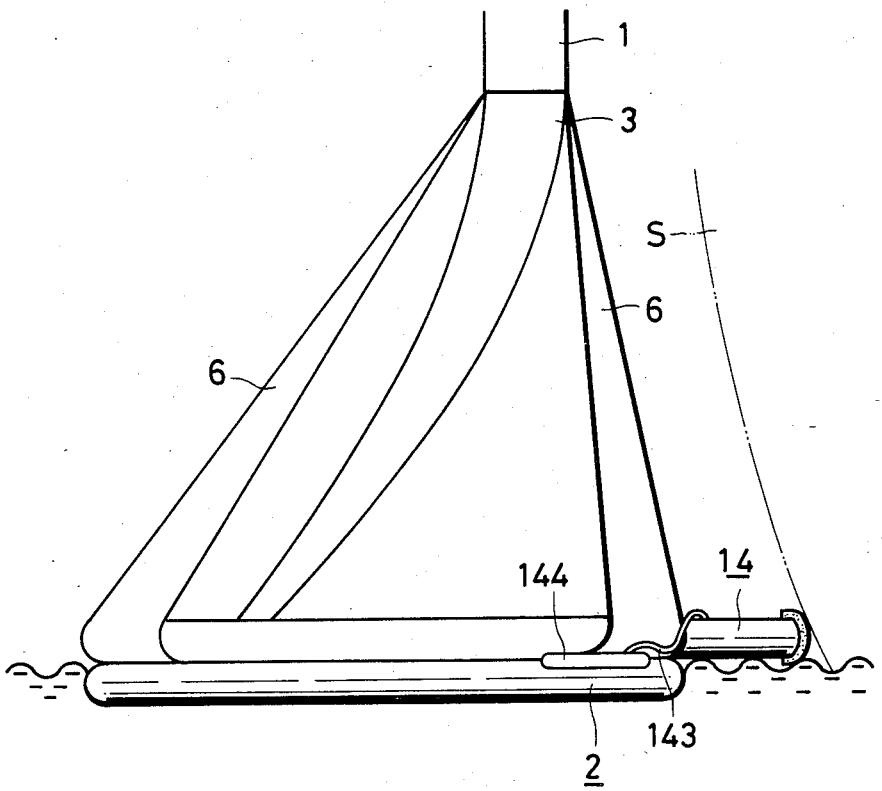
FIG. 25 is a side view of the platform with an additional air bag attached thereto, wherein the air bag functions for the purpose of correcting the position of the platform relative to a ship.
Figure 26:
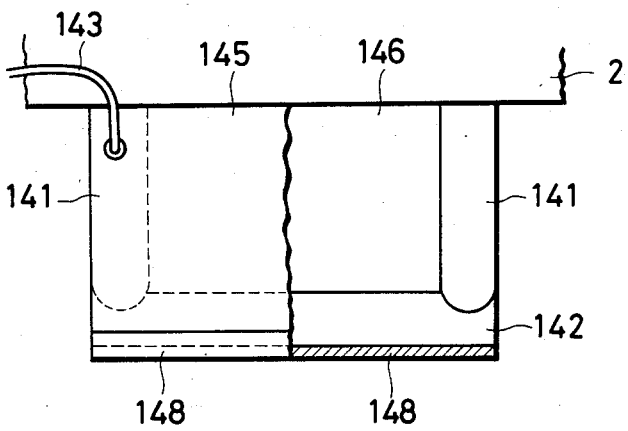
FIG. 26 is a fragmental plan view of the platform in FIG. 25, particularly illustrating how the additional air bag is attached to the platform.

As shown in FIGS. 25 and 26, the additional air bag 14 which is intended to maintain the platform 2 in the properly spaced relation away from the side wall of a ship S comprises two projected air bag columns 141 horizontally extending from the air bag 5 of the platform 2 in parallel with one another with a certain distance kept therebetween and a transverse air bag column 142 adapted to come in contact with the side wall of the ship S. The projected air bag columns 141 are pneumatically communicated with one another by way of the transverse air bag column 142. The additional air bag 14 is caused to expand by filling either of the projected air bag columns 141 and the transverse air bag column 142 with pressurized air.

A flexible hose 143 is jointed to one of the projected air bag columns 141. As shown in FIG. 25, the flexible hose 143 is extended to a bomb 144 mounted on the one side of the platform 2 so that pressurized gas is fed from the bomb 144 by way of it.

Both the air bag columns 141 and 142 are covered with an upper cloth 145 and a lower cloth 146 whereby an area as defined among the air bag columns 141 and 142 is not exposed to the outside.

The one side of the transverse air bag columns 142 located opposite to the side wall of the ship S is adhesively fitted with a layer of elastic foamed material 148 made of foamed polyurethane, polyvinylchloride or the like for the purpose of damping shock caused in the event of an occurrence of collision of the platform 2 against the side wall of the ship S and preventing the projected air bag columns 142 from being damaged or injured due to friction or the like of them.

Obviously, there is no possibility for expanding the additional air bag 14, as long as the platform 2 assumes the properly determined position relative to the main body 1 of the vertical elongated chute. However, in the case where the bottom part of a ship S is inclined downwardly at a steep inclination angle as shown in FIG. 18 and therefore the platform 2 tends to move away from the proper position toward the side wall of the ship S, the additional air bag 14 is expanded by feeding pressurized air from the bomb 144 by way of the flexible hose 143 so as to allow the platform 2 to resume the original predetermined position. As is apparent from FIG. 26, one of the projected air bag columns 141 is first supplied with pressurized air. Since the two projected air bag columns 142 are pneumatically communicated with the transverse air bag column 142, the air bag columns 141 are caused to horizontally project from the platform toward the side wall of the ship S at a right angle relative to the platform 2 in the parallel relation, whereas the transverse air bag column 141 is expanded between both the projected air bag columns 141 at a right angle relative to the latter. As a result, the transverse air bag column 142 comes in contact with the side wall of the ship S with the layer of elastic foamed material 147 interposed therebetween whereby the platform 2 is inhibited from moving toward the side wall of the ship S.

Figure 27:
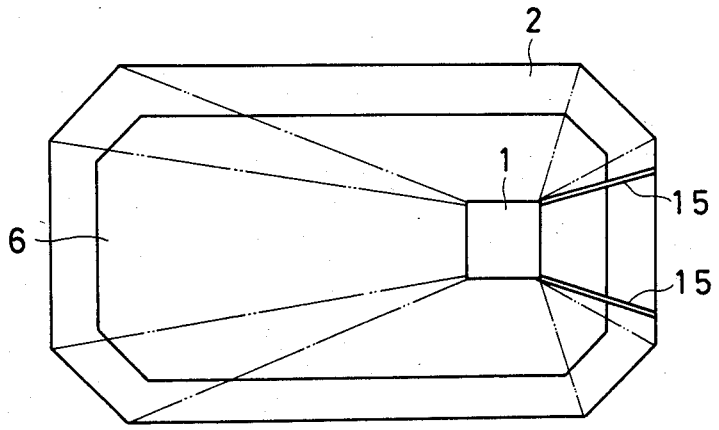
FIG. 27 is a plan view of the platform, particularly illustrating the case where the vertical elongated chute of the invention is held in the prestressed state by means of a plurality of ropes which extend between the main body and the platform.

Alternatively, a plurality of elastic ropes 15 may be extended along the inside of the protective curtain 6 on the side of the platform 2 located opposite to the side wall of a ship S as shown in FIG. 27, in order to inhibit the vertical elongated chute of the invention from moving toward the side wall of the ship S. The one ends of the elastic ropes 15 are jointed to the main body 1 of the chute, whereas the other ends of the same are secured to the air bag 5 of the platform 2 on the side of the latter located opposite to the side wall of the ship S. In the case of the platform 2 as shown in FIG. 27 two elastic ropes 15 are spanned between the main body 1 of the chute and the platform 2 and the one ends of the elastic ropes 15 are jointed to the corners of the main body 1 of the chute having the square cross-sectional configuration on the side located opposite to the side wall of the ship S.

In view of the fact that the vertical elongated chute of the invention is usually accomodated in the case 4 on the deck for a long period of time as safe provision against an occurrence of emergency it is preferable that the elastic ropes 15 has excellently high weather proofness and foldability. Basically, the elastic ropes 15 should not be limited to specific shape and manner of extension. Linear or coiled rubber rope, combination of fibrous rope to rubber rope or the like may be employed for the invention.

In the case where the bottom part of a ship S is inclined downwardly at steep inclination angle and therefore the platform 2 tends to move toward the side wall of the ship S, a part of the elastic ropes 15 spanned between the main body 1 of the chute and the air bag 5 of the platform 2 comes in contact with the ship S and it is then bent in the same manner as illustrated in FIG. 24 with respect to the air bag column 11 whereby the platform 2 resumes the original predetermined position under the effect of elasticity of the elastic ropes 15. The elastic ropes 15 may be used in the presence of the additional air bag 14 as described above.

In the case of the above-described platform 2 two elastic ropes 15 are spanned between the platform 2 and the main body 1 of the chute. Obviously, the number of elastic ropes 15 should not be limited only to two. Alternatively, a single or more than two elastic ropes may be employed for the invention.

As mentioned above, the platform 2 should be preferably inhibited from moving toward the side wall of a ship S. In addition to this it is preferable that it is inhibited from moving in the transverse direction relative to the side wall of the ship as well as from moving up and down.

In order to inhibit movement of the platform 2 in the vertical direction a stabilizing water bags 16 are fixedly secured to the bottom surface thereof in accordance with another modified embodiment of the invention. Filling of the stabilizing bags 16 with water leads to increased weight of the whole platform 2, resulting in movement of the platform 2 in the vertical direction being inhibited successfully.

Figure 28:
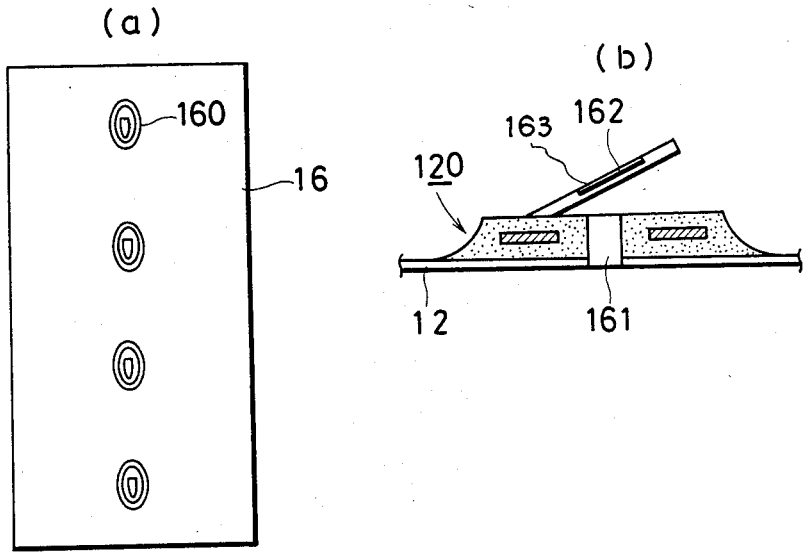
FIG. 28(*a*) is a bottom view of a stabilizing water bag adapted to be secured to the platform.

In this embodiment each of the stabilizing water bags 16 is formed with a plurality of water intake portions 160 on the bottom thereof, as shown in FIG. 28(*a*). As is apparent from the drawing, the water intake portion 160 includes a water intake port 161 which extends therethrough to be opened to the interior of the stabilizing water bag 16 and a check valve 162 whereby water is introduced into the stabilizing water bag 16 by opening the check valve 162. To assure that the water intake port 161 is normally closed with the check valve 162 a heavy plate 163 made of metallic material such as steel plate or the like is embedded in the check valve 162. Thus, while no water is introduced into the stabilizing water bag 16, the water intake port 161 is maintained in the closed state under the effect of dead weight of the check valve 162. Since the check valve 162 is adapted to open toward the interior of the stabilizing water bag 16, water which has been introduced into the latter cannot be discharged therefrom because the check valve 162 is normally held in the closed state. This means that when any load is exerted on the check valve 162 so as to allow water in the stabilizing water bag 16 to be discharged from the latter, the check valve 162 is caused to close under the influence of dead weight of the check valve 162 and water pressure.

As is well known, the conventional stabilizing water bag is secured to the bottom of a boat or the like for the purpose of assuring improved stability but it is not provided with any check valve. Thus, when the stabilizing water bags are raised up above the water surface due to rolling or pitching of the boat, water in the stabilizing water bags is discharged from the latter, causing the boat to move forward further safely. However, in the case of the vertical elongated chute of the invention consideration is concentrated on safety for a person 9 after he removes from a ship S onto the platform 2 but not on movability of the latter. For this reason the check valves 162 are arranged in the above-described manner in order to assure improved stability.

Figure 29:
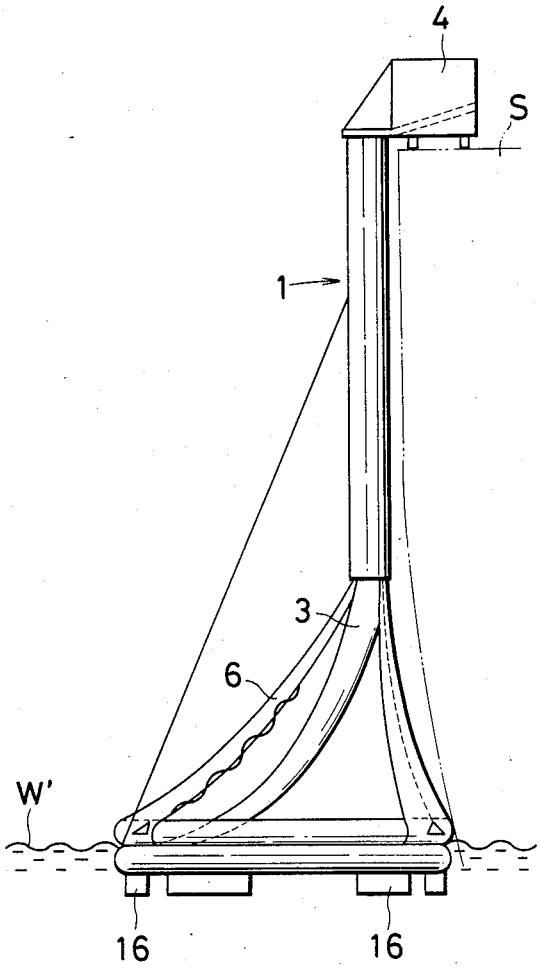
FIG. 29 is a schematic side view of the vertical elongated chute of the invention with a plurality of stabilizing water bags attached to the bottom of the platform.
Figure 30:
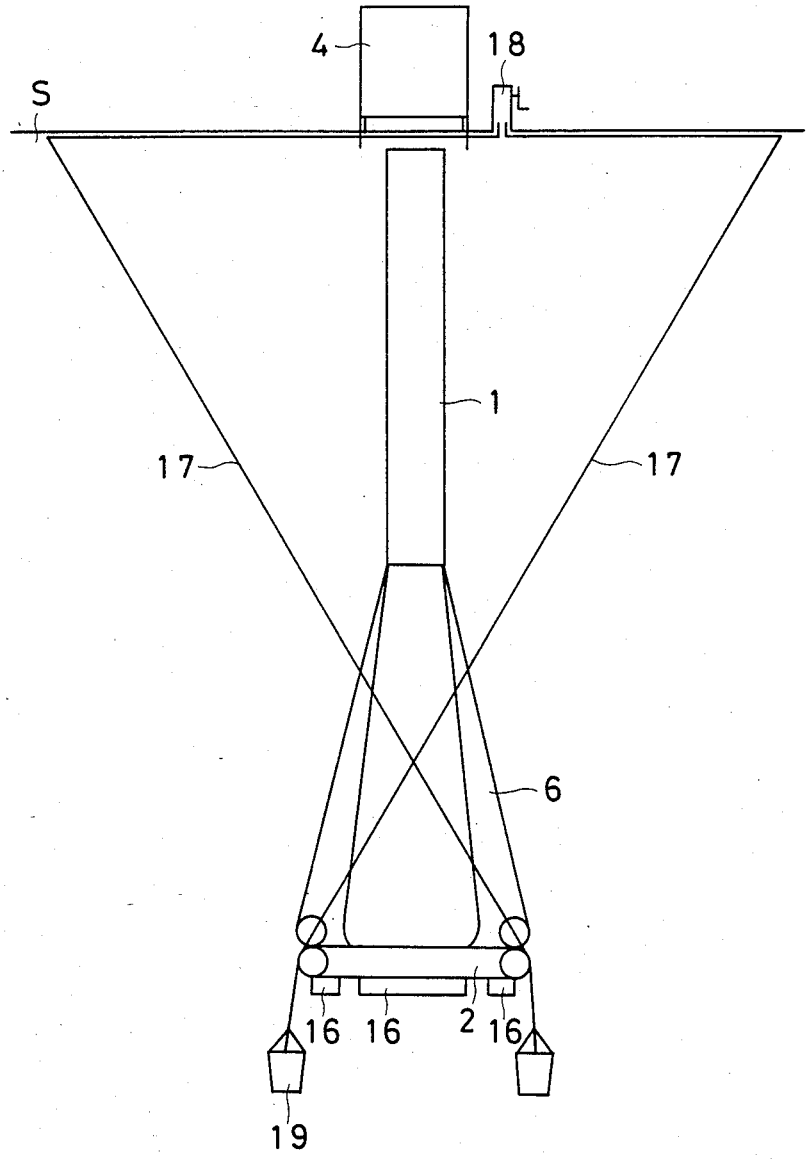
FIG. 30 is a front view of the vertical elongated chute of the invention, particularly illustrating how stays extending between the ship and the platform, stabilizing water bags and sea anchors are employed for the vertical elongated chute.

In the illustrated embodiment the platform 2 is equipped with three stabilizing bags 16 on the bottom of the platform 2 on the side located opposite to the side wall of the ship S as well as three ones on the side located remote from the same, that is, six stabilizing water bags 16 in total so that movement of the platform 2 in the vertical direction is minimized (see FIGS. 29 and 30).

In order to inhibit the platform 2 from moving in the transverse direction relative to the side wall of the ship S, that is, in the direction in parallel with the latter, the platform 2 is held immovable relative to the ship by means of stays 17. As shown in FIG. 30, the stays 17 are diagonally extended between the deck of the ship S and the corners of the platform 2 on the side located remote from the side wall of the ship S. The upper ends of the stays 17 are jointed to a winch 18 whereby they are forcibly stretched by actuating the winch 18. Owing to the arrangement of the stays 17 in that way movement of the platform 2 in the transverse direction (in the direction in parallel with the side wall of the ship) is minimized.

Further, in order to inhibit the platform 2 from moving in the transverse direction in the more reliable manner, the platform 2 is provided with sea anchors 19. Thus, movement of the platform 2 in the transverse direction can be reliably inhibited in cooperation of the sea anchors 19 with the stays 17. As is apparent from the drawing, the sea anchors 19 are designed in the form of a bucket. It will be readily understood that transverse movement of the platform 2 is positively inhibited with the aid of the sea anchors 19 in which water is fully filled.

As will be readily apparent, the vertical elongated chute of the invention usually becomes useless after completion of the intended utilization but the platform 2 is required to be in use as a lifeboat after the main body and the inclined slip way 3 of the vertical elongated chute are used as intended.

Figure 31:
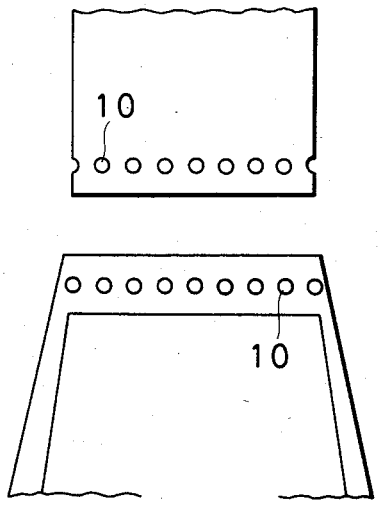
FIG. 31 is a fragmental front view of the vertical elongated chute of the invention, particularly illustrating how the protective curtain is secured to the main body.
Figure 32:
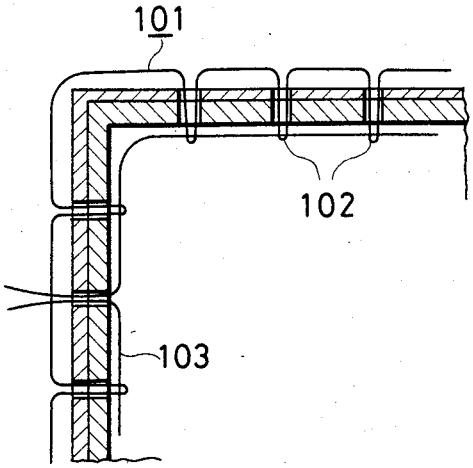
FIG. 32 is fragmental sectional view illustrating how the protective curtain is secured to the main body, shown in an enlarged scale.

To meet the requirement as mentioned above the protective curtain 6 is removably secured to the main body 1 of the chute. Specifically, as shown in FIG. 31, the junction area between the main body 1 of the chute and the protective curtain 6 are formed with a plurality of holes 10. After the holes 10 at the lower end of the main body 1 of the chute are located in alignment with those at the upper end of the protective curtain 6 (see FIG. 32), a rope 101 is inserted through each of the holes 10 in such a manner that a loop 102 is formed inside the protective curtain 6 and the main body 1 and another rope 103 is extended through all the loops 102. Both the ends of the rope 103 are not connected to one another to form a closed loop as is usually seen with the conventional rope but they are inserted through only one of the holes 10 to hang down along the outer surface of the protective curtain 6 (see FIG. 33) so that any person can pull then downwardly without any particular difficulty.

Figure 34:
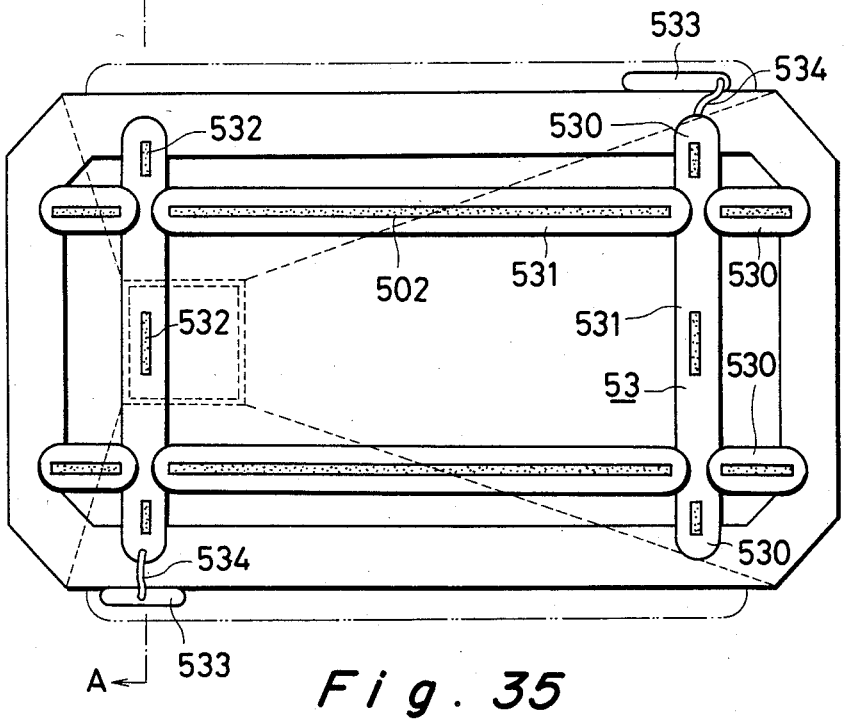
FIG. 34 is a cross-sectional plan view of the vertical elongated chute, particularly illustrating how air bag columns stand upright on the platform for the purpose of supporting the protective curtain.
Figure 35:
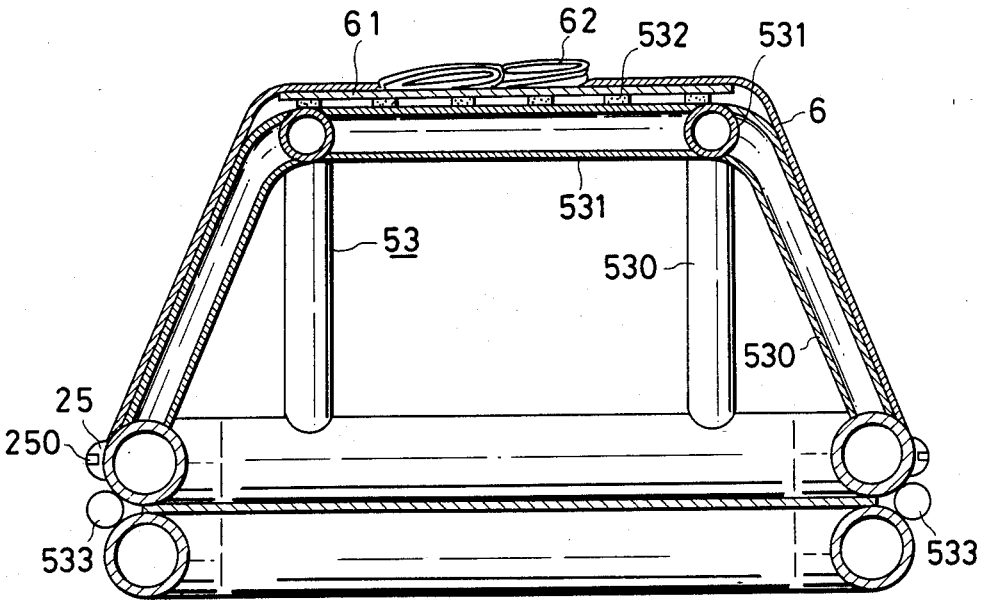
FIG. 35 is a vertical sectional view of combination of platform and protective curtain in FIG. 34.

FIG. 34 is a plan view of a vertical elongated chute in accordance with another embodiment of the invention and FIG. 35 is a vertical sectional view of the vertical elongated chute taken in line A—A in FIG. 34. As is apparent from the drawings, a plurality of air bag columns 53 stand upright from the air bag 5 of the platform 2. Specifically, the air bag columns 53 comprise column bodies 530 standing upright from the air bag 5 of the platform 2 and horizontally extending beams 531 by way of which the adjacent column bodies 530 are pneumatically communicated with one another. As will be best seen in FIG. 34, the air bag columns 53 include two longitudinally extending beams and two transversely extending beams in the rectangular configuration to establish pneumatic communication among the four air bag columns.

Figure 33:
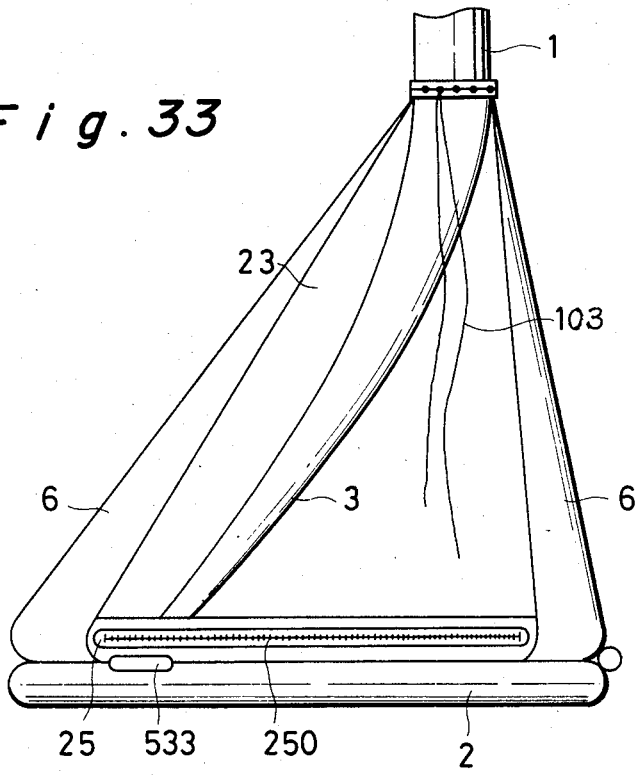
FIG. 33 is a fragmental side view of the vertical elongated chute, particularly illustrating the case where the protective curtain is removably secured to the main body so as to allow the platform to serve as a lifeboat.

Velvet type fasteners 532 are adhesively secured to the outer surface of the column bodies 530 so that the protective curtain 6 is firmly mounted on the column bodies 530 by means of the velvet type fasteners 532. Further, each of the beams 531 is fitted with a velvet type fastener 532 in the longitudinal direction. The velvet type fasteners 532 make it possible to adhesively secure a ceiling curtain 61 to the beams 531 in order to cover a ceiling portion which is built by the combination of plural air bag columns 53. The ceiling curtain 61 is previously provided to be accomodated in the platform 2 as an accessory. As shown in FIGS. 33 and 35, an excessive part 62 of the protective curtain 6 is placed on the ceiling curtain 61 after the latter is extended over the ceiling portion of the air bag columns 53.

The platform 2 is provided with bombs 533 on both the sides thereof and they are pneumatically communicated with the column bodies 530 of the air bag columns 53 by way of two flexible hoses 534 which are detachably connected to the air bag columns 53. As the air bag columns 53 are filled with pressurized air which is delivered from the bombs 533, they are caused to stand upright. As shown in FIG. 33, the air bag columns 53 are not filled with pressurized air as long as the protective curtain 6 is connected to the main body 1 of the chute, but they can stand upright by filling them with pressurized air which is supplied from the bombs 533 after the protective curtain 6 is disconnected from the main body 1. The height of the column bodies 530 as measured when the air bag columns 53 stand upright correctly is determined considerably shorter than the distance between the platform 2 and the junction area whereby the center of weight of the platform 2 which is disconnected from the main body 1 to serve as a lifeboat can be lowered remarkably.

Further, the platform 2 is provided with cover accomodating portions 25 on both the sides of the air bag 5 in which a cover adapted to close the entrance portion 23 therewith through which a person removed from the platform onto the lifeboat, that is, an opened area which is not covered with the protective curtain 6. Each of the cover accomodating portions 250 includes a longitudinally extending fastener 25 so that the cover 24 is taken therefrom by opening the fastener 250.

Figure 36:
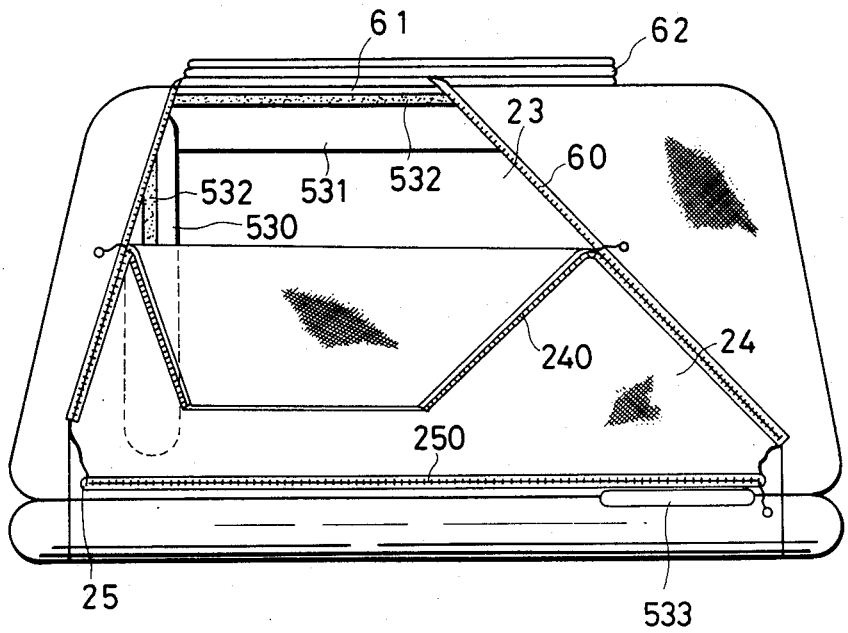
FIG. 36 is a side view of the platform when the latter is used as a lifeboat.

As is apparent from FIG. 36, the cover 25 is designed in the same configuration as that of the entrance portion 23 on the protective curtain 25 and the lower end part of the cover 25 is fixedly secured to the air bag 5. Both the side edges of the cover 24 are fitted with a watertight fastener 240 respectively. On the other hand, both the side edges on the protective curtain 6 are fitted with a watertight fastener 60. Thus, the entrance portion 23 can be closed with the cover in cooperation of the watertight fastener 240 with the watertight fastener 60.

Landing of a person 9 on a lifeboat is achieved by way of the steps of sliding downwardly through the main body 1 of the vertical elongated chute, moving on the inclined slip way 3 at a reduced speed, landing on the platform 2 away from the inclined slip way 3 and then removing from the platform 2 onto the lifeboat through the entrance 23.

On completion of escaping of the person in that way he pulls one of the end parts of the rope 103 by his hands which hang down from the junction area between the main body 1 of the chute and protective curtain 6. As described above, the rope 103 is extended through a number of loops 102 which are formed by the rope 101 around the inside of the junction area and both the end parts of the same are then inserted through one hole 10 on the main body 1 and the protective curtain 6. By pulling one of the end parts of the rope 103 in that way the latter is disengaged from the loops 102 of the rope 101. After the rope 103 is completely removed from the junction area by pulling operation, the protective curtain 6 is pulled downwardly by his hands and thereby a number of loops 102 are removed through the holes 10. As a result, the protective curtain 6 is disengaged from the main body 1 of the chute. Since the inclined slip way 3 is fixedly secured to the lower end of the main body, it is held immovable from the main body 1 regardless of disengagement of the protective curtain 6 from the main body 1.

Next, the ceiling curtain 61 is adhesively secured to the beams 531 by means of the velvet type fasteners 532 to close the ceiling part of the platform 2. The air bag columns 53 are then supplied with pressurized air which is fed from the bombs 533 via the flexible hoses 534. Thus, the air bag columns 53 are caused to stand upright on the air bag 5 of the platform 2 whereby an accomodating room with the ceiling portion mounted thereon is built for persons who have to leave a ship.

Further, to build the side wall of the accomodating room the protective curtain 6 is fixedly secured to the air bag columns 531 by means of the velvet type fasteners 532. The upper part of the protective curtain 6, that is, an extra part 62 of the same is placed on the ceiling curtain by folding it.

After the air bag columns 53 are completely filled with pressurized air which is delivered from the bombs 533, the flexible holes 534 are disconnected from the air bag columns 53 and the fasteners 250 of the cover accomodating portions 25 disposed on both the sides of the air bag 5 are then opened to take the covers 24 therefrom. By engaging the watertight fasteners 240 on both the side edges of the covers 24 to the watertight fasteners 60 on both the side edges of the protective curtain 6, the entrance portions 23 are closed with the covers 24 whereby a closed accomodating room is built on the platform 2 for the persons.

As will be readily understood from the above description, the vertical elongated chute of the invention has an advantageous feature that any person who has to leave a ship can land on the platform from the deck of the ship without any occurrence of stoppage of descending movement of the person at the bent parts of the zigzag slip down passage owing to employment of elastic cloth at the bent parts inclusive of the area located in the vicinity thereof. As a result, escaping movement of the person can be carried out at a remarkably improved efficiency.

While the present invention has been described above with respect to several preferred embodiments thereof, it should of course be understood that it should not be limited only to them but various changes or modifications may be made in any acceptable manner without departure from the spirit and scope of the invention as defined by the appended claims.

What is claimed is:

1. In a vertical elongated chute of the type including a vertically extending main body having a high intensity of strength, said main body comprising a base cloth of which both longitudinally extending side edges are jointed to one another to build a tubular zigzag slip down passage to which a zigzag slip down passage cloth is fixedly secured, an inclined slip way jointed to the lower end of the main body and a platform engaged to the foremost end of said inclined slip away so that a person who has to leave a ship lands thereon safely, the improvement consisting in that the zigzag slip down passage cloth is provided with an expansible cloth at least at each of a plurality of bent parts along the zigzag slip down passage so that the latter is enlarged when dead weight of the descending person is exerted to the area where said expansible cloth is attached to the zigzag slip down passage cloth, wherein expansibility of the expansible cloth is determined in the range of 200 to 250% as seen in the longitudinal direction as well as in the peripheral direction of the zigzag slip down passage.

2. A vertical elongated chute as defined in claim 1, wherein the expansible cloth has strength of 400 g/m$^2$ or more than the same, tensile strength of 50 Kg/cm or more than the same and tearing strength of 17 Kg/cm or more than the same.

3. A vertical elongated chute as defined in claim 1, wherein breaking strength of the expansible cloth is determined more than 260%.

4. A vertical elongated chute as defined in claim 1, wherein restorability of the expansible cloth is determined less than 3%.

5. A vertical elongated chute as defined in claim 1, wherein expansibility of the zigzag slip down passage cloth is determined in the range of 30 to 60% as seen in the longitudinal direction and in the range of 15 to 30% as seen in the peripheral direction of the zigzag slip down passage and breaking strength of the same is determined more than 140%.

6. A vertical elongated chute as defined in claim 1, wherein the zigzag slip down passage cloth has strength of 400 g/m$^2$ or more than the same, tensile strength of 50 Kg/cm or more than the same and tearing strength of 17 Kg/cm or more than the same.

7. A vertical elongated chute as defined in claim 1, wherein an electric conductive cloth of which resistance value is determined in the range of $10^2$ to $10^5$ ohms is used for at least a part of the zigzag slip down passage cloth which constitutes the zigzag slip down passage cloth.

8. A vertical elongated chute as defined in claim 1, wherein the inclined slip way comprises a tubular portion jointed to the lower end of the main body and an opened landing portion jointed to the platform and wherein the one ends of adjustment ropes fixedly secured to the tubular portion of the inclined slip way or the main body are attached to both the side parts of the landing portion so as to carry out relative displacement as seen in the longitudinal direction and the other ends of the same are connected to winding means so as to allow the adjusting ropes to be wound thereabout while they are stretched.

9. A vertical elongated chute as defined in claim 1, wherein the inclined slip way comprises a tubular portion jointed to the lower end of the main body and an opened landing portion jointed to the platform, said landing portion being provided with a plurality of shock absorbing members at least on the bottom thereon.

10. A vertical elongated chute as defined in claim 1, wherein the platform includes an air bag column on the side located opposite to the side wall of a ship, said air bag column standing upright on the platform.

11. A vertical elongated chute as defined in claim 1, wherein the platform includes an additional air bag on the side located opposite to the side wall of a ship for the purpose of determining a correct position relative to the latter.

12. A vertical elongated chute as defined in claim 1, wherein the platform includes an air bag for generating buoyancy, a floor cloth disposed below said air bag so as to allow a person to stand thereon safely and an additional air bag disposed below said floor cloth so as to allow the peripheral part of the floor cloth to be raised up so that the floor cloth is stretched tightly.

13. A vertical elongated chute as defined in claim 1, wherein the platform includes an air bag for generating buoyancy and a floor cloth disposed below said air bag so as to allow a person to stand thereon safely, the inner periphery of said air bag and the peripheral part of said floor cloth being tightened by means of ropes in order to assure that the floor cloth is held in the stretched state at all times.

14. A vertical elongated chute as defined in claim 1, wherein elastic ropes are spanned between the platform on the side located opposite to the side wall of a ship and the main body on the side located opposite to the same.

15. A vertical elongated chute as defined in claim 1, wherein stays are diagonally spanned between the corners of the platform on the side located remote from the side wall of a ship and the deck or the like on the ship and stabilizing water bags with check valves mounted thereon are attached to the bottom of the platform on the side located opposite to the side wall of a ship as well as on the side located remote of the same.

16. A vertical elongated chute as defined in claim 1, wherein the platform includes a protective curtain adapted to be detachably jointed to the main body in such a manner that said protective curtain is hung down from the joint area of the main body, the lower end of the protective curtain being jointed so the platform, and wherein the platform is provided with a plurality of air bag columns which serve to support the protective curtain when the latter is disconnected from the main body so that it can be used as a lifeboat.

* * * * *